US008287104B2

(12) United States Patent
Sharan et al.

(10) Patent No.: US 8,287,104 B2
(45) Date of Patent: Oct. 16, 2012

(54) INKJET PRINTHEAD WITH GRADED DIE CARRIER

(75) Inventors: Alok Sharan, Lake Oswego, OR (US); Robert N K Browning, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 450 days.

(21) Appl. No.: 12/622,001

(22) Filed: Nov. 19, 2009

(65) Prior Publication Data

US 2011/0115854 A1 May 19, 2011

(51) Int. Cl.
*B41J 2/05* (2006.01)

(52) U.S. Cl. ..... 347/67

(58) Field of Classification Search ..... 347/67
See application file for complete search history.

(56) References Cited

U.S. PATENT DOCUMENTS

| | | | | |
|---|---|---|---|---|
| 6,343,848 | B2 | 2/2002 | Berg et al. | |
| 6,774,482 | B2 | 8/2004 | Colgan et al. | |
| 7,347,522 | B2 | 3/2008 | Kubo | |
| 2005/0162482 | A1 * | 7/2005 | Lim et al. | 347/63 |

FOREIGN PATENT DOCUMENTS

| | | |
|---|---|---|
| JP | 62-251151 | 10/1987 |
| JP | 01-249353 | 10/1989 |

* cited by examiner

*Primary Examiner* — Jerry Rahll
(74) *Attorney, Agent, or Firm* — Nathan R. Rieth

(57) ABSTRACT

An inkjet printhead includes a die having a heating element formed thereon. The inkjet printhead also includes a graded die carrier. The graded die carrier is coupled to the die. The graded die carrier has lands that are separated by an ink slot. Each of the lands is graded such that its proximity to the die varies.

8 Claims, 8 Drawing Sheets

INKJET PRINTHEAD WITH GRADED DIE CARRIER

BACKGROUND

In a thermal bubble inkjet printing system, an inkjet printhead prints an image by ejecting ink droplets through a plurality of nozzles onto a print medium, such as a sheet of paper. The nozzles are typically arranged in one or more arrays, such that properly sequenced ejection of ink from the nozzles causes characters or other images to be printed on the print medium as the printhead and the print medium move relative to each other. Thermal inkjet printheads eject droplets from a nozzle by passing electrical current through a heating element to generate heat and vaporize a small portion of the fluid within a firing chamber. The current is supplied as a pulse which lasts on the order of 2 micro-seconds. When a current pulse is supplied, the heat generated by the heating element creates a rapidly expanding vapor bubble that forces a small droplet out of the firing chamber nozzle. When the heating element cools, the vapor bubble quickly collapses, drawing more fluid from a reservoir into the firing chamber in preparation for ejecting another drop from the nozzle.

During printing, heat from the heating elements influences the temperature of the thermal inkjet die. The temperature of the thermal inkjet die has a significant influence on characteristics of the ink droplets being fired from the nozzles, and can therefore have an adverse impact on the overall print quality of the printing system. For example, a higher temperature in the die results in a higher drop weight and a higher drop velocity, while a lower die temperature results in a lower drop weight and velocity. Thus, variations in temperature across the die can result in droplets of different weight being ejected onto the print medium. Differences in the drop weight (and drop velocity, to a lesser degree) can have a considerable impact on the print quality. Drops with lower drop weight being ejected from a cooler area of the die can result in areas on the print medium having less ink than intended. The areas printed with less ink will appear to be lighter than other areas printed with drops of higher drop weight that are ejected from warmer areas of the die. Variations in drop weight can also adversely affect the color accuracy of the printing system. In general, the problems caused by variations in drop weight and velocity are referred to as light area banding (LAB), die boundary banding (DBB), and hue shift.

BRIEF DESCRIPTION OF THE DRAWINGS

The present embodiments will now be described, by way of example, with reference to the accompanying drawings, in which.

Throughout the drawings, identical reference numbers designate similar, but not necessarily identical, elements.

DETAILED DESCRIPTION

Overview of Problem and Solution

As noted above, in thermal inkjet (TIJ) printing systems, variations in temperature across a thermal inkjet die influence characteristics of the ink drops (e.g., drop weight, drop velocity) being ejected from nozzles onto the print medium. This causes problems such as light area banding (LAB), die boundary banding (DBB), and hue shift, all of which reduce the overall print quality of the printing system.

Figure 1A:
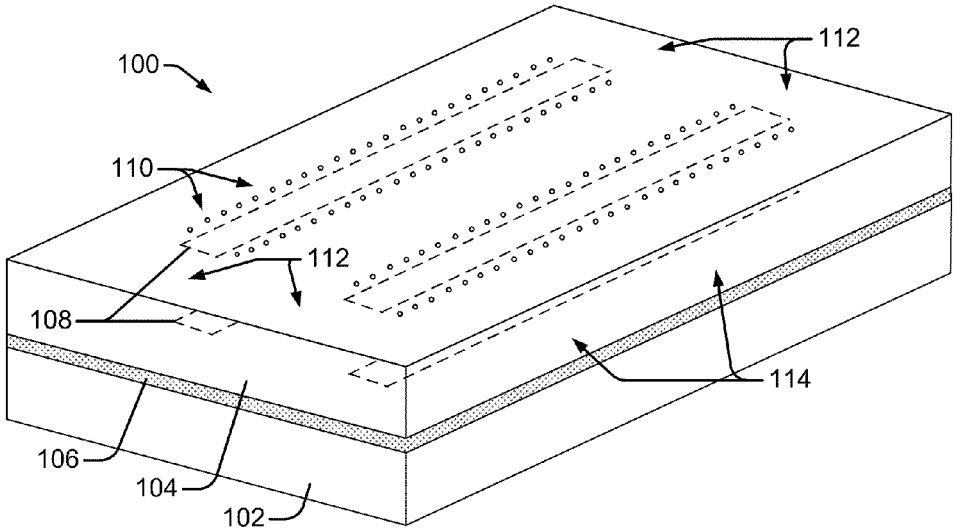
PRIOR ART FIG. 1A
FIGS. 1A and 1B show a partial view of an example conventional thermal inkjet printhead according to the prior art.
Figure 1B:
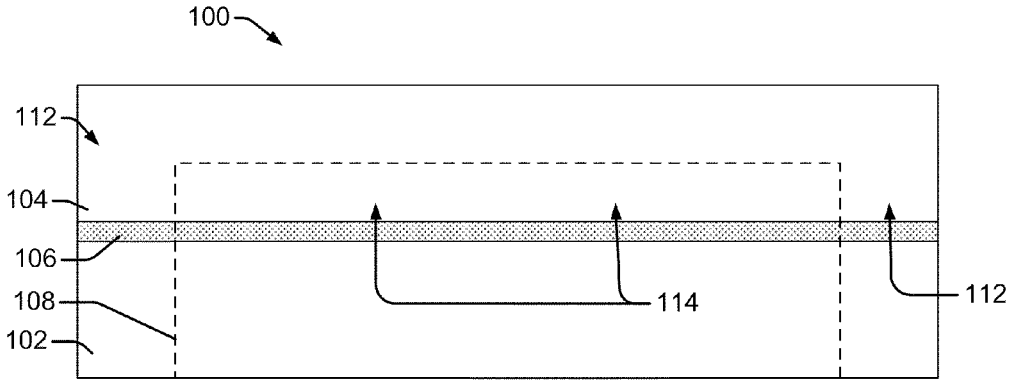
PRIOR ART FIG. 1B

A source of these problems is an imbalance between the heat being input and the heat being removed across different regions of the TIJ printhead during operation. FIGS. 1A and 1B show a partial view of an example conventional thermal inkjet printhead 100. The printhead 100 includes a die carrier (substrate) 102, a silicon die 104, and an adhesive layer 106 that bonds the die 104 to the die carrier 102. Also included in printhead 100, but not specifically shown, are a barrier layer with ink chambers and a nozzle plate. Dashed lines 108 are intended to represent the approximate location of ink-feed slots 108 within the die carrier 102 and die 104 that supply ink to nozzles 110. Heat is input or generated mostly along the edges of the ink-feed slots 108 in the area of the firing resistors (not shown) which are located on the die 104 at the bottom of firing chambers under each of the nozzles 110. Heat is primarily removed by the ink that flows through the slots 108 and out the nozzles 110. The end regions 112 of the die (past the ends of the slots 108) present significant area for heat conduction into the thermally conductive die carrier 102 to which the die 104 is bonded. In these end regions 112, the heat conducted into the die carrier 102 is not balanced by the heat input. The heating and cooling conditions in the end regions 112 are different from the heating and cooling conditions in the central regions 114. In the central region heat is deposited and there is little contact area for heat transfer to the die carrier. In contrast, in the end regions there is no heat deposited and there is a relatively large area for heat transfer to the die carrier. These regional differences between heat input and heat removal cause the end regions 112 of the die 104 to be cooler than the central regions 114 of the die 104.

The problems related to variations in temperature across thermal inkjet die affect both "scanning-carriage" (i.e., multi-pass) and "page-wide array" (i.e., single-pass) thermal inkjet printing systems. Scanning-carriage TIJ printing systems have an inkjet printhead mounted on a carriage that is moved back and forth across the print media. Since each pass across the media creates a "print swath" that is on the order of an inch in height, numerous passes are needed to print a single page. Thus, scanning-carriage TIJ printers are significantly slower than some other forms of printers, such as laser printers, which can produce page-wide images. Page-wide array TIJ printing systems have multiple printhead die in a printhead module. Thus, print swaths can span an entire page width, or a substantial portion of a page width, which allows inkjet printers to compete with laser printers in print speed.

However, in both scanning-carriage and page-wide array thermal inkjet printing systems, prior methods of dealing with the LAB and hue shift problems associated with variations in temperature across thermal inkjet die tend to increase print time and/or print costs. In scanning-carriage TIJ systems, the LAB and hue shift problems are typically solved algorithmically, by performing additional, overlapping passes across the print media. The additional passes cover the print defects, but require additional print time. In page-wide array TIJ systems, LAB and hue shift problems are typically solved by using extra print bars employing additional printhead die. The additional printhead die effectively provide additional printing passes over printed areas which cover the print defects. However, this method of covering the defects adds additional cost to the printing system.

Embodiments of the present disclosure overcome disadvantages such as those mentioned above by balancing the temperature across the TIJ printhead die. A graded die carrier to which the TIJ die is coupled, provides a varying distance or gap between the die and the die carrier. A varying adhesive bond-line thickness fills the varying gap between the die and die carrier and provides better thermal insulation toward the ends of the die than at the center of the die. The increased thermal insulation toward the ends of the die increases the temperature at the ends of the die relative to the center of the die, thus maintaining a more balanced temperature across the whole die.

In one embodiment, for example, an inkjet printhead includes a die having a heating element and a graded die carrier coupled to the die. The graded die carrier has lands separated by an ink slot, each land graded such that its proximity to the die varies. Each land includes a flat top land in a close proximity to the die, a sloped land extending away from each of two ends of the top land in a decreasing proximity to the die, and a flat bottom land extending away from each sloped land and in a distant proximity to the die.

In another embodiment, a method of balancing temperature across a thermal inkjet printhead die includes providing greater insulation between the die and a die carrier at the ends of the die than at the center of the die. The die is adhered to the die carrier with an adhesive bond layer that is thicker at the ends of the die than it is at the center of the die.

In another embodiment, a method of fabricating an inkjet printhead includes forming a die that has a heating element for heating ink, and forming a die carrier that has graded lands separated by an ink slot. Each land has a land top, land slopes, and land bottoms. The die is adhered to the die carrier such that the land top is in close proximity to the die, the land slopes are in a varying proximity to the die, and the land bottoms are in a distant proximity to the die.

Illustrative Embodiments

Figure 2:
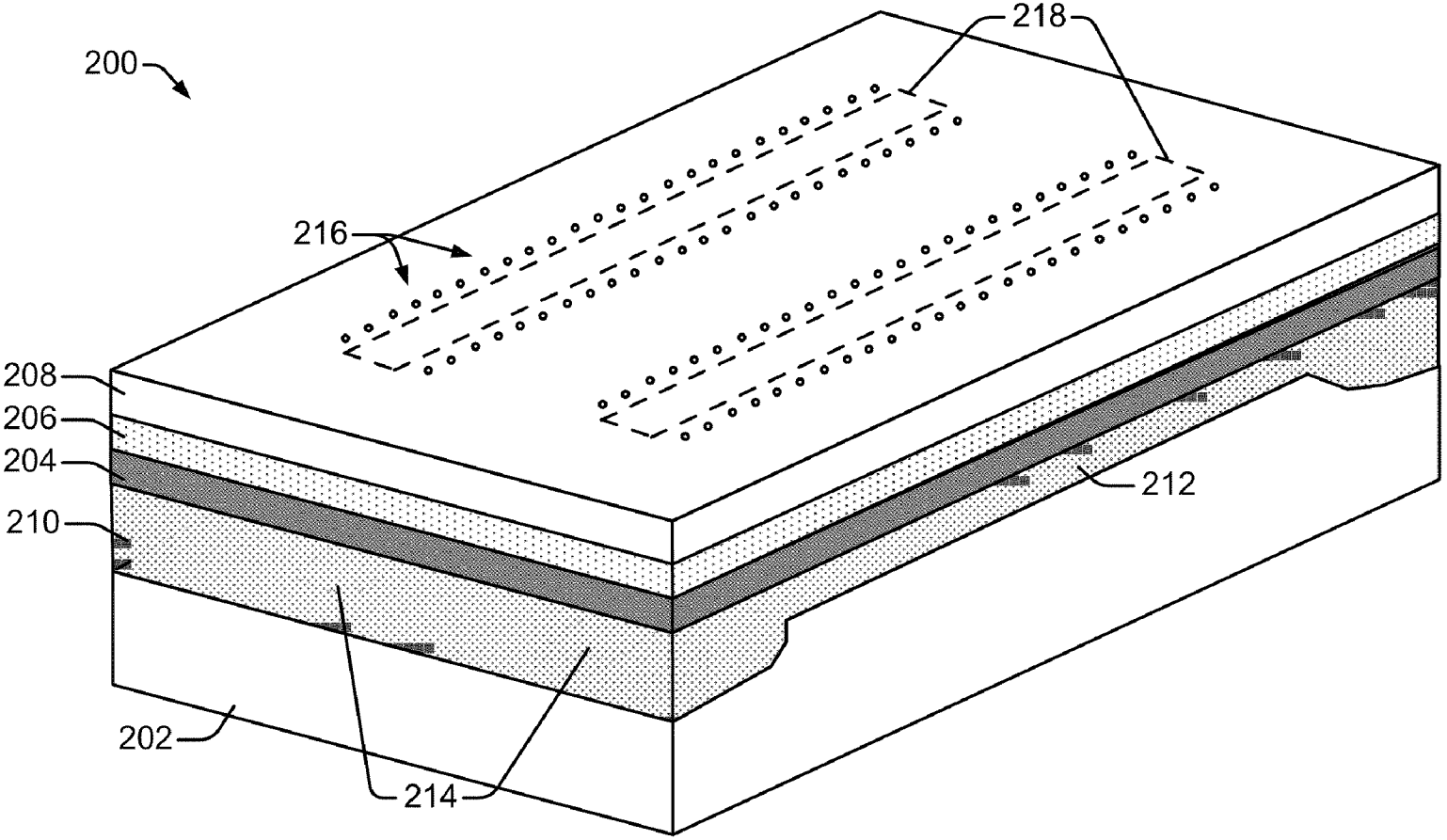
FIG. 2 shows a partial perspective view of an example thermal inkjet printhead, according to an embodiment.

FIG. 2 shows a partial perspective view of an example thermal inkjet printhead 200, according to an embodiment. The printhead 200 generally includes a die carrier (substrate) 202, a die 204, a barrier or chamber layer 206, and a nozzle plate or layer 208. Die 204 is adhered to die carrier 202 by an adhesive bond layer or line 210, which is transparently illustrated in FIG. 2. It is noted that the adhesive bond line 210 may be any appropriate insulating substance and is not necessarily limited to an adhesive substance. Moreover, as one skilled in the art will recognize, an adhesive substance generally has a lower thermal conductivity than the thermal conductivity of materials forming the die 204 and die carrier 202, such as silicon and ceramic, for example. Die carrier 202 may be, for example a separate structure which lies between the adhesive bond layer 202 and the housing (or "body") of printhead 200, or it may be an integral portion of the housing (or "body") of printhead 200 to which the die 204 is directly bonded. Die carrier 202 can be made, for example, of ceramic, metal, or plastic. Plastic is a poor conductor of heat compared to ceramic and metal, which both have a higher heat capacity and are more highly heat conductive. Therefore, a TIJ printhead having a plastic die carrier does not exhibit the LAB and hue shift problems mentioned above to the same extent as a printhead having a ceramic or metal die carrier. However, the use of ceramic or metal for die carrier 200 provides advantages over plastic, since ceramic and metal provide a more robust and stress-free joint between the die carrier 200 and the TIJ die 204. Accordingly, although die carrier 200 may be plastic, ceramic, or metal, the benefits of reduced LAB and hue shift associated with die carrier 200 discussed herein are realized to a greater degree when the die carrier is a ceramic or metal material.

Figure 3:
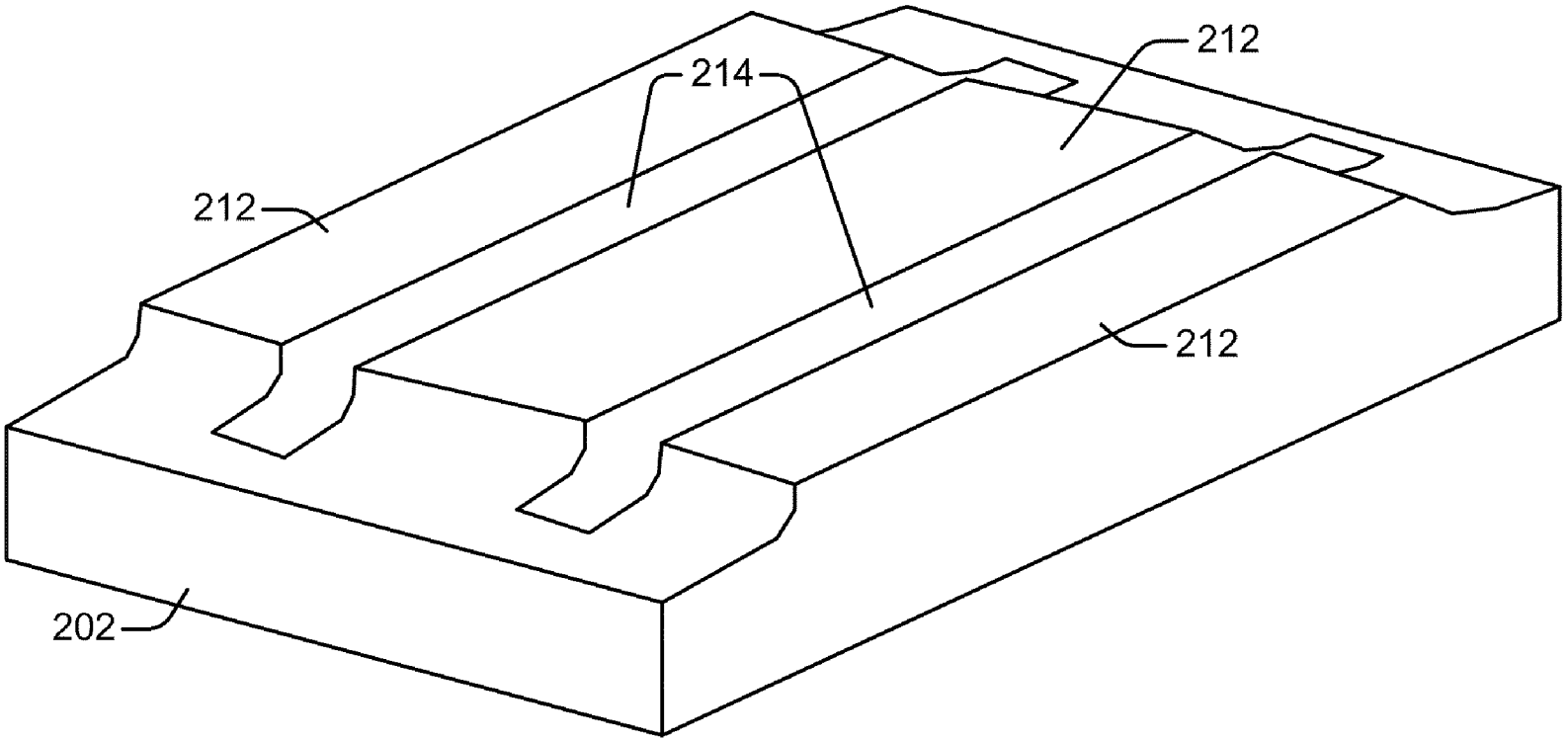
FIG. 3 shows a perspective view of a die carrier where graded lands are apparent, according to an embodiment.

Die carrier 202 is a graded die carrier having graded lands or ribs 212. FIG. 3 shows a perspective view of die carrier 202 according to an embodiment, wherein the graded lands 212 are more apparent. The graded lands of die carrier 202 are separated by ink-feed slots 214. Ink slots 214 can be partially seen in FIG. 2 through the transparently illustrated adhesive bond line 210. Ink slots 214 provide a flow of ink to the thermal, or resistive, elements (not shown in FIG. 2; see 504, FIG. 5) formed on the die 204 which cause ink drop ejection through nozzles 216 in nozzle plate 208. Therefore, although it is not completely illustrated in FIG. 2, the ink slots 214 extend from the die carrier 202 at least partially into the bottom side of the die 204. This is illustrated by the dashed lines 218 which indicate the approximate location of the ink slots 214 in the die 204, underlying the nozzle and chamber layers (208, 206).

Figure 4:
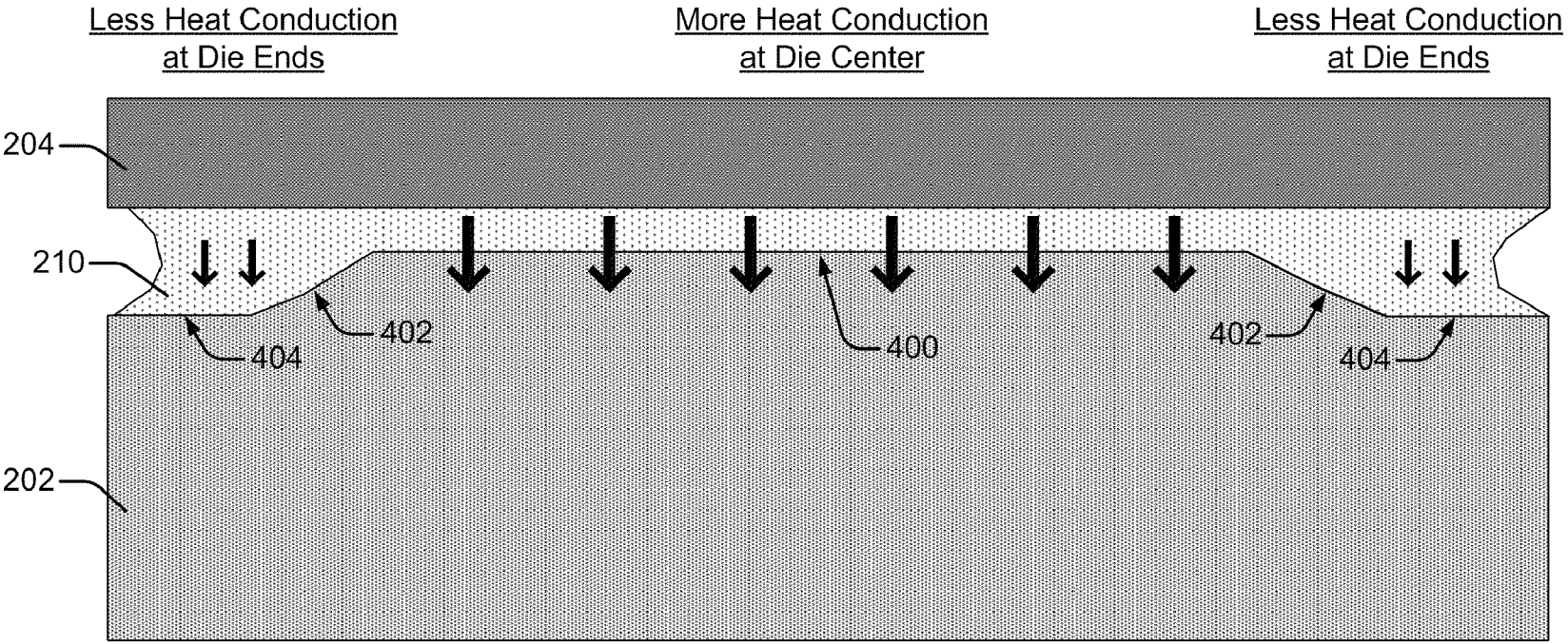
FIG. 4 shows a side view of an example of a die carrier and die coupled together by an adhesive bond line, according to an embodiment.

The graded lands 212 of die carrier 202 are graded such that their proximity to die 204 varies. This variation can be better appreciated in the illustration of FIG. 4. FIG. 4 shows a side view of an example of the die carrier 202 and die 204 coupled together by the adhesive bond line 210, according to an embodiment. As is apparent from FIG. 4, each graded land 212 has a flat top land area 400 that is in a close proximity to the die 204 and that corresponds to the center region of the die. On either side of the top land 400 are sloped land areas 402 that extend the land 212 away from the center region of the die 204 and toward the end regions of the die, away from each of the two ends of the top land 400. The sloped land areas 402 are in a decreasing proximity to the die 204. Next to each sloped land area 402, is a flat bottom land area 404 that extends the land 212 further away from the top land 400 and further toward the ends of the die 204, away from each sloped land area 402. The flat bottom land areas 404 are in a most distant proximity to the die 204.

The variation in proximity of the graded land 212 to the die 204 creates a varying gap size between the die 204 and die carrier 202. As is apparent from FIGS. 2 and 4, the thickness of the adhesive bond line 210 varies in correspondence with the proximity of the graded lands 212 to the die 204, so as to fill the varying gap between the die 204 and die carrier 202 with adhesive. That is, as the graded land 212 slopes down and away from die 204 toward the ends of the die 204 (i.e., as the proximity decreases), the adhesive bond line 210 thickness increases in an inverse manner to fill the increased gap between the die carrier 202 and the die 204.

The increase in the gap toward the ends of the die 204 between the die 204 and the highly heat conductive die carrier 202, coupled with the corresponding increase in thickness of the adhesive bond line 210 at the ends of the die 204, create an insulating effect that retains more heat at the ends of the die 204 while conducting more heat away from the center area of the die 204 through the die carrier 202. As noted above, an adhesive substance generally has a lower thermal conductivity than the thermal conductivity of materials forming the die 204 and die carrier 202 (e.g., silicon and ceramic), and can be selected based on the property of low thermal conductivity to provide greater insulation at the ends of the die 202. As shown in FIG. 4, less heat conducts through the adhesive bond line 210 and into the die carrier 202 at the ends of the die 204, while more heat conducts through the adhesive bond line 210 and into the die carrier 202 at the center of the die 204. This provides greater thermal uniformity across the length of the die 204, and thereby helps to alleviate LAB and hue shift problems associated with variations in temperature across the die that would otherwise adversely influence characteristics of the ejected ink drops (e.g., drop weight, drop velocity).

Figure 5A:
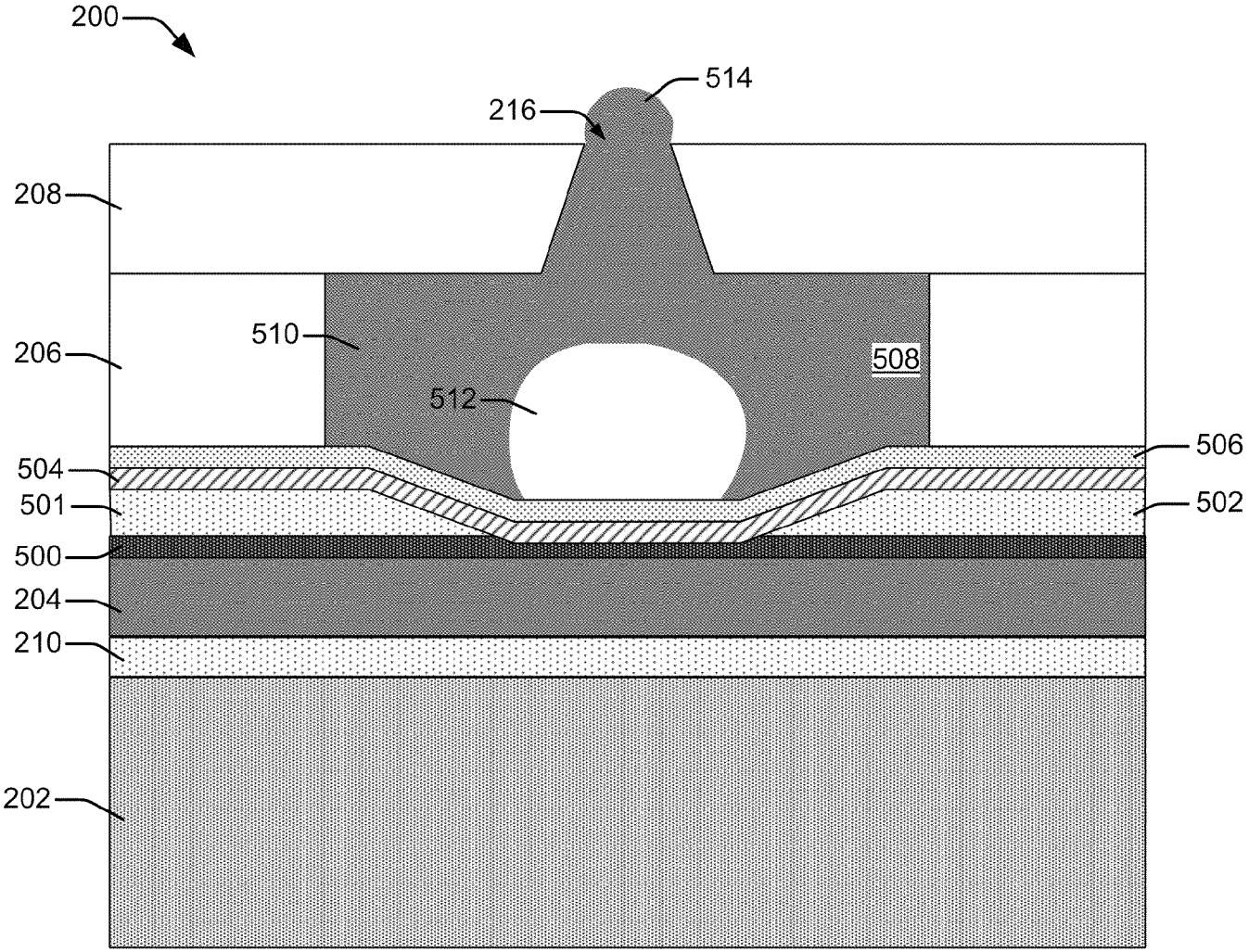
FIG. 5A shows a partial side view of the example thermal inkjet printhead in detail, according to an embodiment.

FIG. 5A shows a partial side view of the example thermal inkjet printhead 200 in greater detail, according to an embodiment. Referring now to FIGS. 2 and 5, as noted above, the example TIJ printhead 200 includes die carrier 202, die 204, chamber layer 206, and nozzle plate layer 208. Die 204 is adhered to die carrier 202 by an adhesive bond layer or line 210. The die 204 is typically made of Si with a dielectric layer 500 such as SiO2 between electrodes 501 and 502, and the silicon die 204. Aluminum electrodes (501, 502) may be deposited over part of the die 204. A heating element 504 is typically a resistor layer of tungsten silicon nitride (WSiN) or tantalum aluminum alloy, for example, deposited on the surface of die 204 and over the aluminum electrodes (501, 502). The heating element 504 may be deposited by conventional integrated circuit fabrication techniques such as sputtering a resistive material over the die 204 and electrodes (501, 502). One or more additional overcoat layers 506 can be formed over the heating element 504 to provide additional structural stability and electrical insulation from fluid in the firing chamber 508.

The barrier or chamber layer 206 is typically formed on the die 204 as a dry film laminated by heat and pressure, for example, or as a wet film applied by spin coating. The chamber layer 206 material is a photoimageable polymer such as SU8. Chamber(s) 508 are formed in the chamber layer 206 by common photoimaging techniques. Nozzle plate 208 includes nozzle orifice(s) 216 formed over respective chamber(s) 508 such that each chamber 508, associated nozzle 216, and associated heating element 504 are aligned.

During operation, TIJ printhead 200 ejects droplets of ink through nozzles 216 by passing electrical current (e.g., a pulse on the order of 2 micro-seconds) through heating elements 504 to generate heat and vaporize a small portion of the ink 510 within firing chamber 508. When a current pulse is supplied, the heat generated by the heating element 504 creates a rapidly expanding vapor bubble 512 that forces a small droplet 514 out of the firing chamber nozzle 216. When the heating element 504 cools, the vapor bubble 512 quickly collapses, drawing more fluid from a reservoir into the firing chamber 508 in preparation for ejecting another drop from the nozzle 216.

Figure 5B:
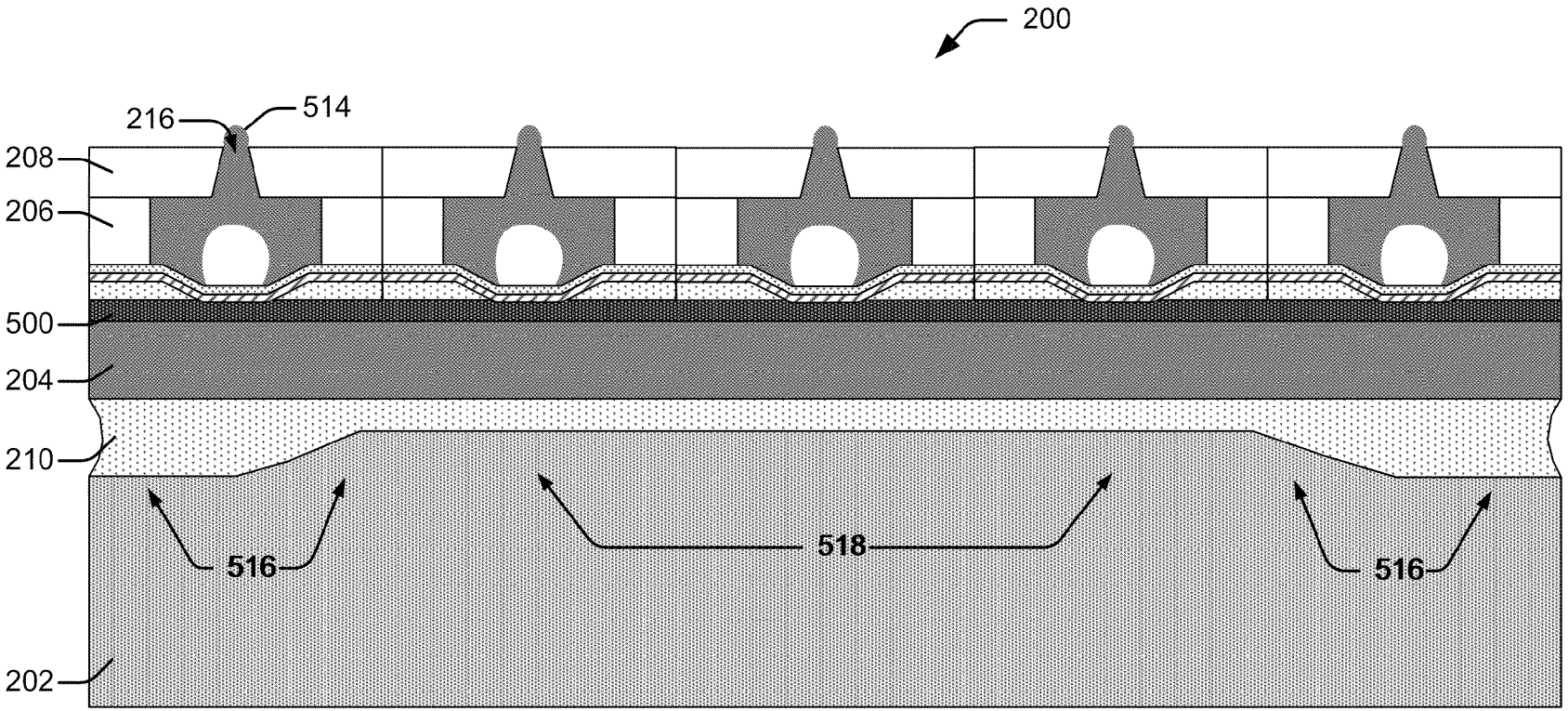
FIG. 5B shows an extended view of the example thermal inkjet printhead of FIG. 5A, according to an embodiment.

FIG. 5B shows an extended view of the example thermal inkjet printhead 200 in FIG. 5A, according to an embodiment. FIG. 5B shows a number of heating elements 504 with corresponding chambers 508 and nozzles 216 formed on the silicon die 204, and is intended to further illustrate features of the die carrier 202 and adhesive bond line 210 discussed above with respect to FIG. 4, for example. Thus, the increasing gap between the die 204 and the highly heat conductive die carrier 202 toward the ends 516 of the die 204 is apparent. Also apparent is that the thickness of the adhesive bond line 210 increases from the center 518 of the die 204 toward the ends 516 of the die 204 in correspondence with the increasing gap between the die 204 and die carrier 202. As noted above, these features create an insulating effect that retains more heat at the ends 516 of the die 204 while conducting more heat away from the center 518 area of the die 204 through the die carrier 202.

Figure 6:
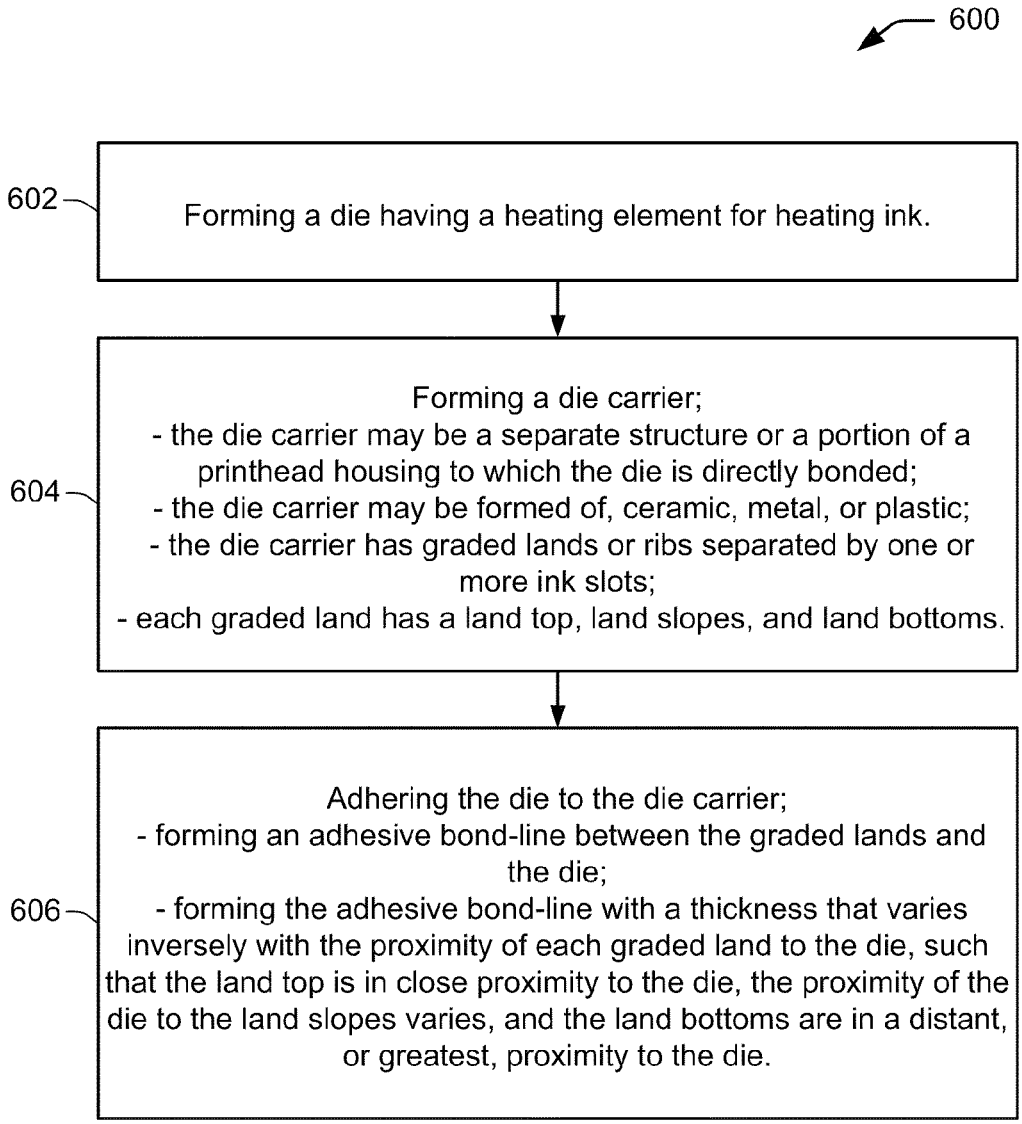
FIG. 6 shows a flowchart of an example method of fabricating a thermal inkjet printhead, according to an embodiment.

FIG. 6 shows a flowchart of an example method 600 of fabricating a thermal inkjet printhead, according to an embodiment. Method 600 is associated with the embodiments of a thermal inkjet printhead 200 discussed above with respect to illustrations in FIGS. 2-5. Although method 600 includes steps listed in a certain order, it is to be understood that this does not limit the steps to being performed in this or any other particular order. In general, the steps of method 600 may be performed using various precision microfabrication techniques such as electroforming, laser ablation, anisotropic etching, sputtering, dry etch, photolithography, casting, molding, stamping, and machining as are well-known to those skilled in the art.

Method 600 begins at block 602 with forming a die having a heating element for heating ink. At block 604, a die carrier is formed. The die carrier may be a separate structure or a portion of a printhead housing to which the die is directly bonded. The die carrier can be made of, for example, ceramic, metal, or plastic. The die carrier has graded lands or ribs that are separated by one or more ink slots. Each of the graded lands has a land top, land slopes, and land bottoms. At block 606 of method 600, the die is adhered to the die carrier. Adhering the die to the die carrier includes forming an adhesive bond-line between the graded lands and the die. Forming the adhesive bond-line includes forming the adhesive bond-line with a thickness that varies inversely with the proximity of each graded land to the die. That is, as the proximity of the graded land to the die decreases (i.e., the gap gets larger), the adhesive bond-line thickness increases. Upon adhering the die to the die carrier, the land top is in close proximity to the die. The proximity of the die to the land slopes varies. The land bottoms are in a distant, or least, proximity to the die.

Figure 7:
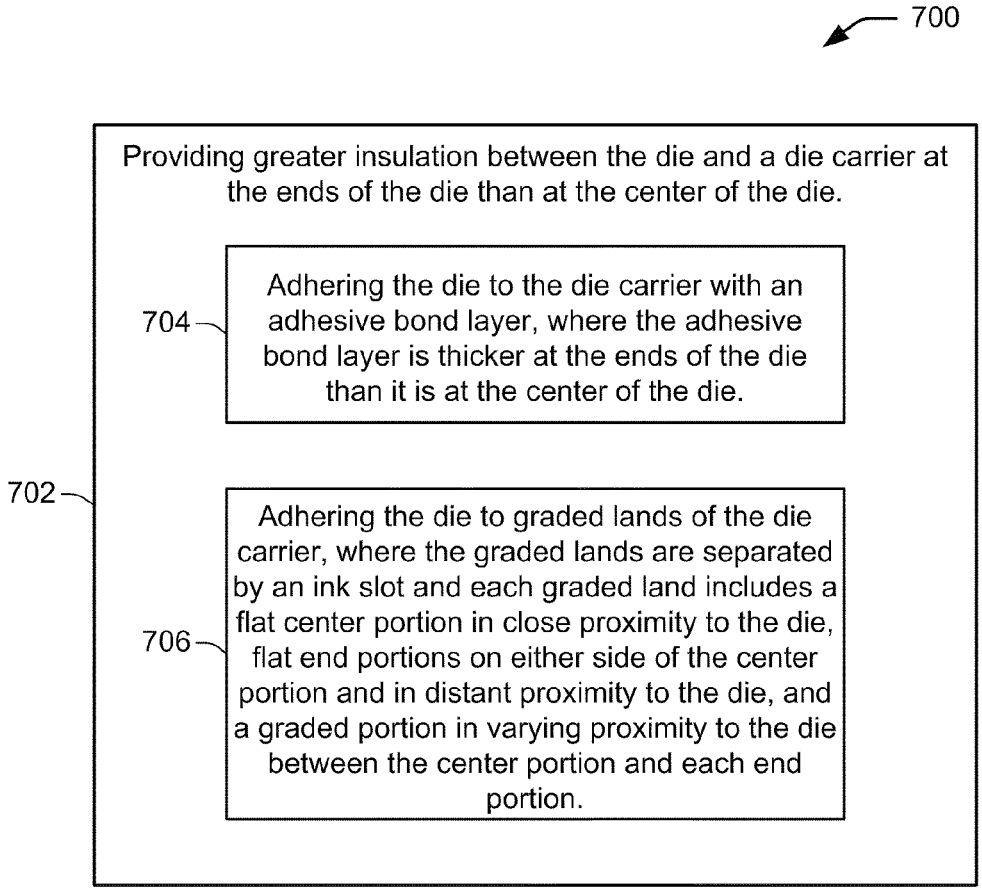
FIG. 7 shows a flowchart of an example method 700 of balancing temperature across a thermal inkjet printhead die, according to an embodiment.

FIG. 7 shows a flowchart of an example method 700 of balancing temperature across a thermal inkjet printhead die, according to an embodiment. Method 700 is associated with the embodiments of a thermal inkjet printhead 200 discussed above with respect to illustrations in FIGS. 2-5. Although method 700 includes steps listed in a certain order, it is to be understood that this does not limit the steps to being performed in this or any other particular order.

Method 700 of balancing temperature across a thermal inkjet printhead die begins at block 702 with providing greater insulation between the die and a die carrier at the ends of the die than at the center of the die. At block 704, the method 700 continues such that the step of providing greater insulation between the die and a die carrier includes adhering the die to the die carrier with an adhesive bond layer. The adhesive bond layer is thicker at the ends of the die than it is at the center of the die. At block 706, the method 700 continues such that the step of providing greater insulation between the die and a die carrier includes adhering the die to graded lands of the die carrier. The graded lands are separated by an ink slot and each graded land includes a flat center portion in close proximity to the die, flat end portions on either side of the center portion and in distant proximity to the die, and a graded portion in varying proximity to the die between the center portion and each end portion.

What is claimed is:

1. An inkjet printhead comprising:

a die having a heating element formed thereon; and a graded die carrier coupled to the die and having lands separated by an ink slot, each land graded such that its proximity to the die varies, and each land comprising a flat top land in a close proximity to the die, a sloped land extending away from each of two ends of the top land in a decreasing proximity to the die, and a flat bottom land extending away from each sloped land and in a distant proximity to the die.

2. An inkjet printhead as in claim 1, wherein the flat top land corresponds to a center portion of the die, the flat bottom lands correspond to end portions of the die, and the sloped lands correspond to portions of the die between the center and end portions of the die.

3. An inkjet printhead as in claim 1, further comprising an adhesive bond-line between the lands and the die that varies in thickness with the varying proximity of each land to the die.

4. An inkjet printhead as in claim 3, wherein the thickness of the adhesive bond-line varies inversely with the varying proximity of each land to the die.

5. An inkjet printhead as in claim 1, wherein the die carrier comprises a material selected from the group of ceramic, metal and plastic.

6. An inkjet printhead as in claim 1, wherein the die carrier comprises a portion of a printhead housing to which the die is directly bonded.

7. An inkjet printhead as in claim 1, further comprising an ink chamber and nozzle through which ink droplets are ejected by applying current to the heating element.

8. A method of fabricating an inkjet printhead comprising:

forming a die having a heating element for heating ink;

forming a die carrier having graded lands separated by an ink slot, each land having a land top, land slopes, and land bottoms; and adhering the die to the die carrier such that the land top is in close proximity to the die, the land slopes are in a varying proximity to the die, and the land bottoms are in a distant proximity to the die, wherein adhering comprises forming an adhesive bond-line between the graded lands and the die, the adhesive bond-line having a thickness that varies inversely with the proximity of each graded land to the die.

* * * * *